US007147337B1

(12) United States Patent
Rapisarda

(10) Patent No.: US 7,147,337 B1
(45) Date of Patent: Dec. 12, 2006

(54) MODULE FOR LIGHTED GARMENTS, SHOES OR ACCESSORIES

(76) Inventor: Carmen Rapisarda, 21211 Whisteria St., Apple Valley, CA (US) 92308

( * ) Notice: Subject to any disclaimer, the term of this patent is extended or adjusted under 35 U.S.C. 154(b) by 62 days.

(21) Appl. No.: 10/773,647

(22) Filed: Feb. 6, 2004

(51) Int. Cl.
*F21V 21/08* (2006.01)

(52) U.S. Cl. ..... 362/103

(58) Field of Classification Search ..... 362/103
See application file for complete search history.

(56) References Cited

U.S. PATENT DOCUMENTS 2,505,154 A * 4/1950 Smith ..... 362/103
3,161,843 A 12/1964 Hodges et al.
3,403,366 A 9/1968 Klatte et al.
3,876,926 A 4/1975 Schott et al.
4,011,398 A 3/1977 Munz et al.
4,655,524 A * 4/1987 Etzel ..... 439/71
5,366,780 A 11/1994 Rapisarda
5,649,755 A 7/1997 Rapisarda
5,947,580 A * 9/1999 Chien ..... 362/103
6,017,128 A 1/2000 Goldston et al.
RE37,220 E 6/2001 Rapisarda et al.

* cited by examiner

*Primary Examiner*—Ali Alvai
*Assistant Examiner*—William J Carter
(74) *Attorney, Agent, or Firm*—John E. Wagner; Robert S. Smith; Roy L. Anderson

(57) ABSTRACT

A no-lead electrical module for illuminating lamps in shoes and other clothing or accessories, includes a circuit board having a number of conductor tracks and a battery with opposite poles. A metal spring clamp holds the battery against the circuit board and also makes contact with one side of the battery and a conductor track, A switch has two terminals secured to different conductor tracks by means of spring clamps. Other components are secured to conductor traces or tracks with spring clamps. A two conductor wire carrying a lamp makes contact with the tracks by additional spring clamps. The module is encapsulated. In a second embodiment, spring clamps are held by a non-conductive resilient pad overlying the circuit board and clamped to the leads by means of a non-flexible board with screws to the circuit board to force the leads against their conductor traces. A third embodiment uses no circuit board.

17 Claims, 3 Drawing Sheets

FIG 1
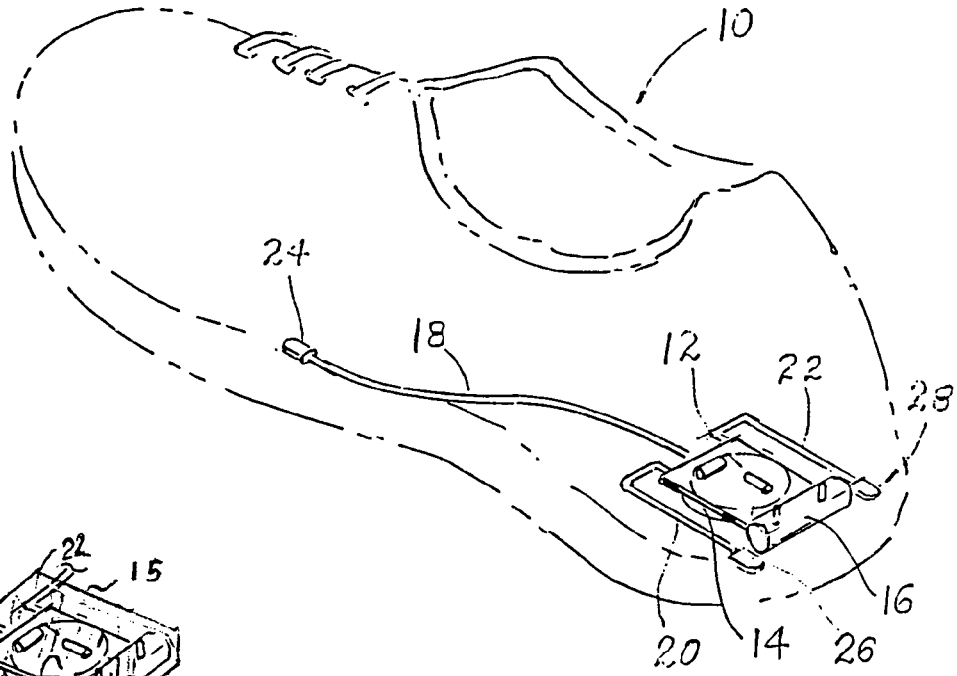
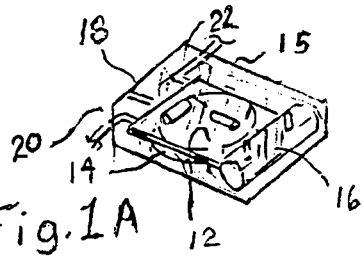
Fig.1A
Fig.2
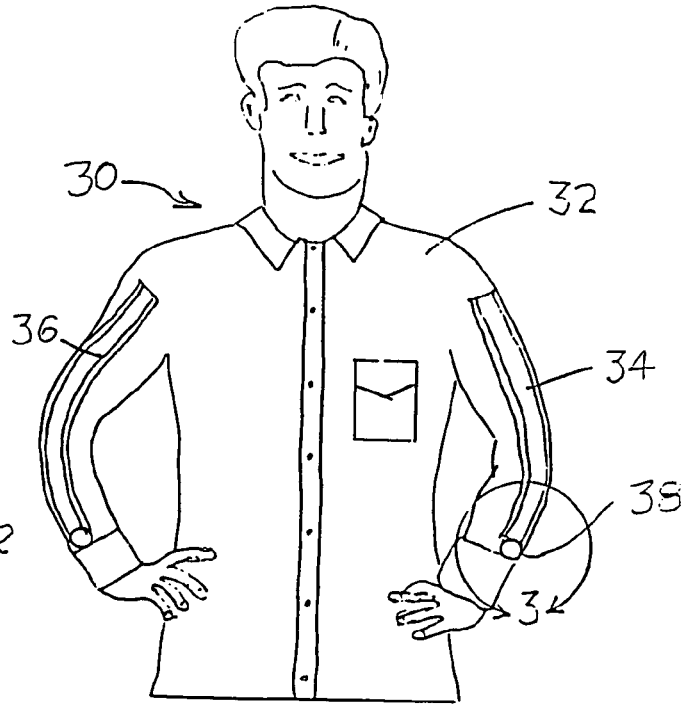
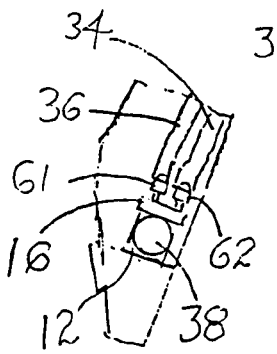
Fig.3

FIG 6
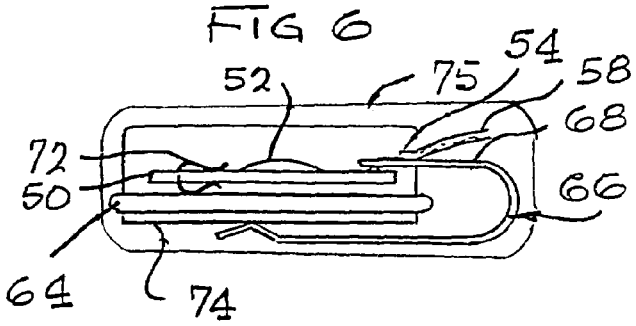
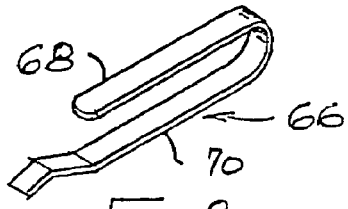
FIG 8
FIG 7
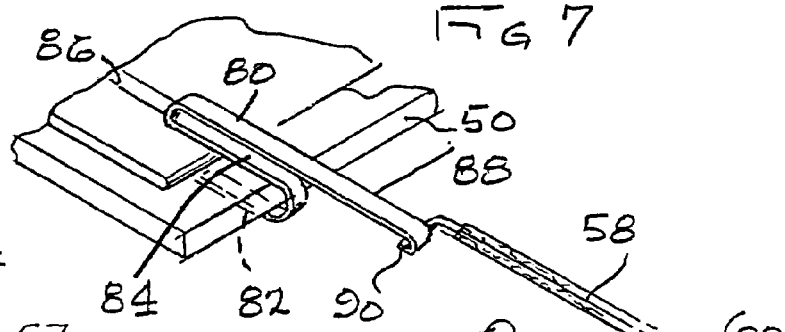
FIG 4
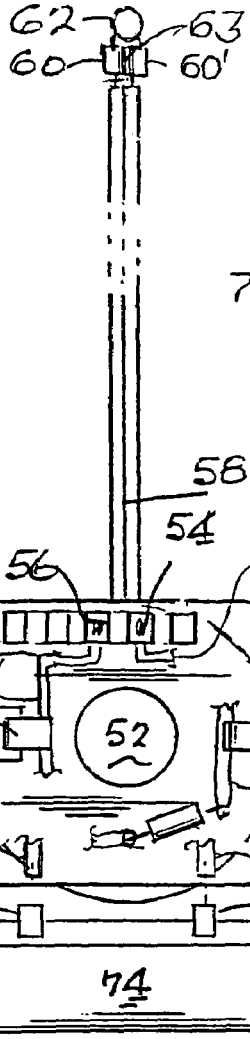
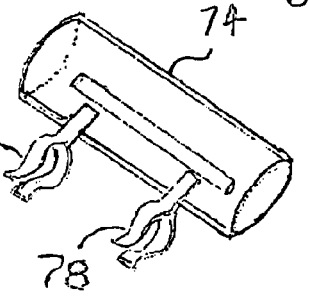
FIG.9
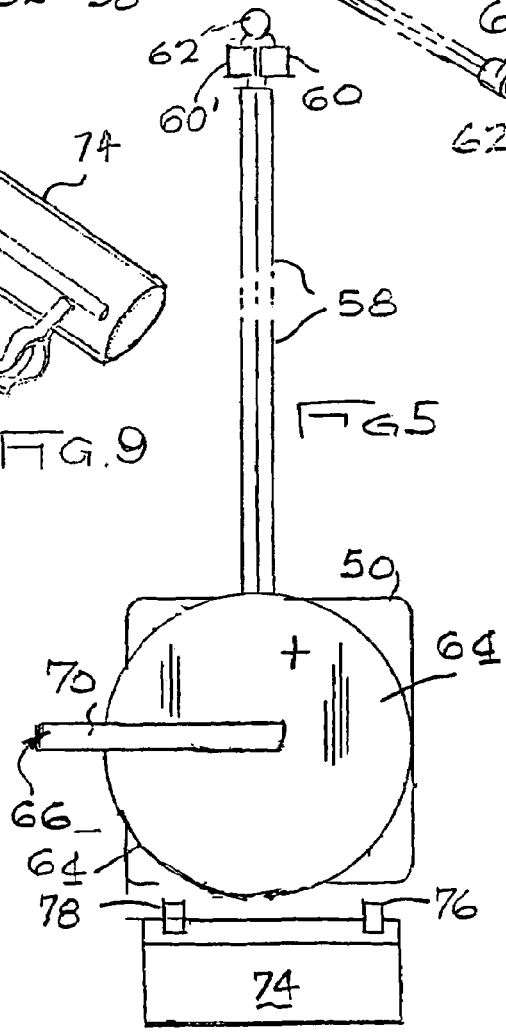
FIG5

FIG 10
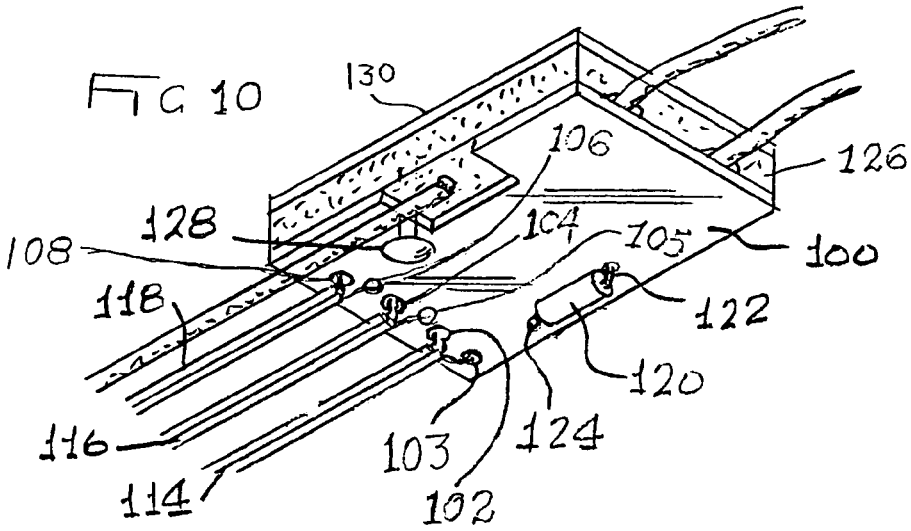
FIG 11
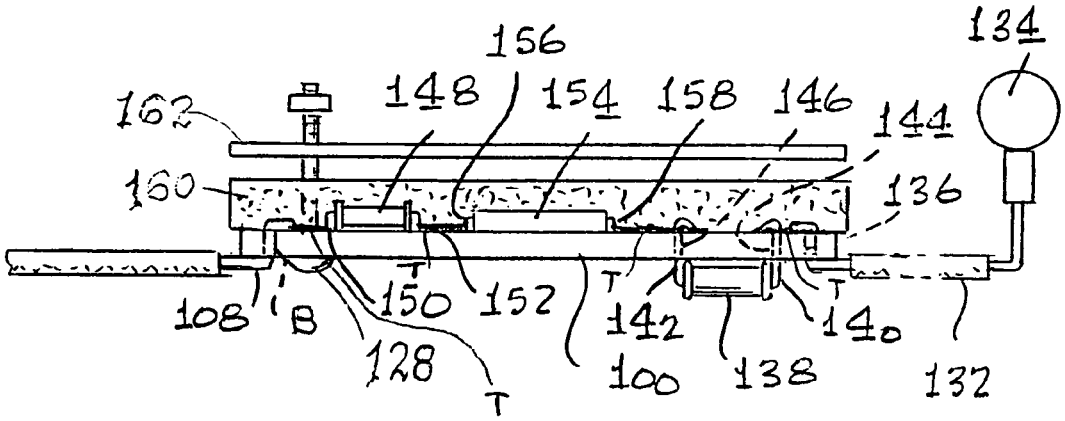
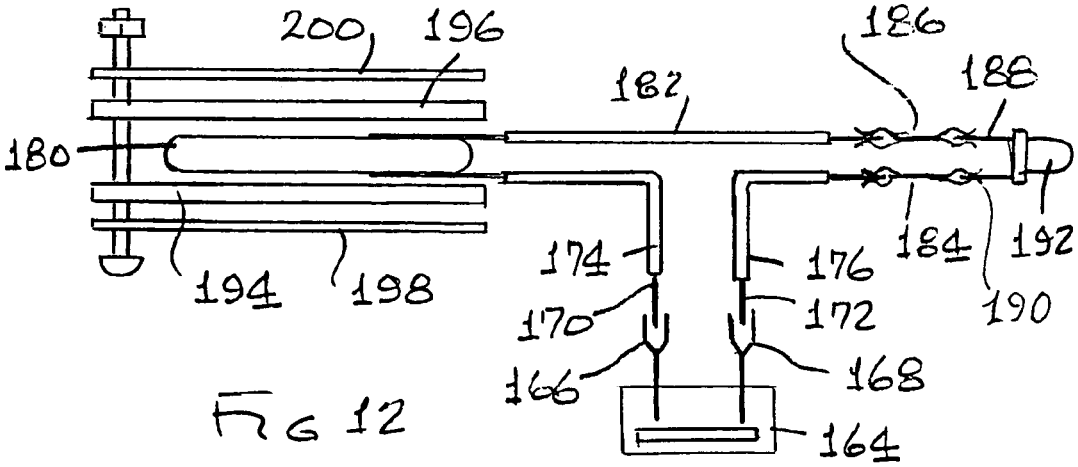
FIG 12

MODULE FOR LIGHTED GARMENTS, SHOES OR ACCESSORIES

BACKGROUND OF THE INVENTION

The present invention relates to wearing apparel, to footwear, to other garments, and to accessories, such as backpacks, worn with lighting elements. Footwear and garments with flashing lights have been popular for a number of reasons, including safety, an attractive appearance, and simply for a novelty effect.

Lighting units for footwear have typically included a light source, such as one or more light-emitting diodes, a power source, such as a battery, and a switch to cause the power source to be connected to the light or lights. Often such units will include electronic circuit modules which can control the time such lights are actually illuminated, which limits the power consumption, saving the battery. Characteristically, electronic circuits have used lead or lead/tin solder in many components and joints. From 1992 to present, all children's lighted shoes contain lead. A search of the art discloses by this invention no attempt to remove lead (Pb) from shoes.

There has been a considerable effort to minimize or remove lead from the environment, and particularly from children's rooms and toys. In carrying out this effort, it is desirable to provide lighting modules for shoes and other garments that are lead free (Pb). As such lighting circuit modules become more popular, they are often incorporated into garments, especially shoes for children. The modules that are concealed in shoes are usually glued or cemented into the heels and are generally inaccessible, but as these shoes find their way into landfills, the toxic lead can possibly leach out causing contamination of the environment. Other modules and associated wiring, which may be in jackets, shirts, or backpacks, also include a number of solder joints that contain lead. While larger electronic components are seldom relegated to landfills, worn out clothing and shoes, often is.

Children's electronically lighted shoes, in particular, are not recyclable and, when worn out or outgrown, typically end up on landfills. The accumulation over time of many millions of shoes with modules containing lead carries a risk of the lead getting into ground water, thereby polluting drinking water sources. It is desirable that this possible source of contamination be eliminated. It is believed that it is only of question of time before any electronic assemblies containing lead-based solder will be legislatively banned from landfills.

BRIEF SUMMARY OF THE INVENTION

To avoid exposing children or others and the environment to contact with lead, the applicant has devised an electronic module for illuminating lamps used in shoes or other clothing or accessories wherein the normally soldered electrical connections are replaced with non-soldered connections, including mechanical spring clamps or clips and pressure pads. Such pads may include a non-conductive foam sandwich to hold wires in contact with conductive traces on circuit boards.

Principal components of such a module include:

a) a circuit board having a number of conductor "printed circuit" traces;

b) one or more lamps and wires from the circuit board to the lamps;

c) a battery connected to the circuit board for powering the lamps;

d) a switch for turning the lamp or lamps on and off;

e) leads from LEDs or lamps connected to wires;

f) spring connectors, mechanical clamps, foam clamp pads, crimping connections; and g) shrinkable non-conductive material for encapsulating the module;

The battery is typically in the form of a coin size cell, lithium wafer in which opposite sides are of opposite polarity.

A switch, which may be an inertia switch, is generally elongated and has a terminal at each end. Spring clamps connect the terminals to conductor tracks on the circuit board and also mechanically connect and secure the switch to the circuit board.

Contacts on the circuit board are connected with conductor tracks and spring clamps mechanically and electrically secure wires from the lamp or lamps to the conductor tracks. From the foregoing, it will be recognized that spring clamps secure electrical connections:

a) between the battery and conductor traces on the circuit board in addition to mechanically securing the battery to the circuit board;

b) between the switch and conductor traces on the circuit board in addition to mechanically attaching the switch to the circuit boards; and c) between the lamps and connecting wires and from connecting wires to the circuit board.

In one embodiment, a first spring clamp mechanically secures the battery to the circuit board and electrically connects one side of the battery to one of the conductor tracks. Another spring clamp connects the other side of the battery to another conductor track.

The entire assembly is enclosed in a plastic encasement, potted or covered with a conformal coating which is in intimate contact with the joints as well as the components.

In another embodiment, all or part of the wires from the switch, from the lamp or from other components are clamped against tracks on a circuit board by pressure from a resilient, non-conductive pad, such as polyfoam, which is held against the circuit board by means of a hard, non-flexible layer or plate which may be held by spring clamps or by screws passing through the circuit board and the plate. The exterior encasement, potting or conformal coating upon curing shrinks and applies pressure to the pressure pad, which maintains electrical connections under the pad.

It is possible to produce a lighting circuit for shoes and other garments and accessories which employs no circuit board at all. A simplified such circuit is described below.

The above-described assembly is then preferably encased in potting compound. Such potting compound encapsulation or conformal coating must be compatible with the resilient pad and non-corrosive of any component of metallic materials and joints.

With all the electrical and mechanical connections completed as described, the module is then encapsulated in potting compound which shrinks as it cures effectively providing a compressional force due to the resin shrinking from curing which maintains the connections in spite of the physical abuse to which children's shoes and other lighted garments may be exposed.

BRIEF DESCRIPTION OF THE DRAWINGS

This invention may be more clearly understood with the following detailed description and by reference to the drawings in which:

FIG. 1 is a perspective view of a shoe, shown in phantom, with a prior art lighting system;

FIG. 1A is a plan view of a lighting system incorporating this invention, including encapsulation in a potting compound;

FIG. 2 is a front view of an individual wearing a shirt or jacket, including flexible lighting strips and employing the lead free module in the lighting system of this invention;

FIG. 3 is an enlarged fragmentary view of the encircled portion of FIG. 2 designated with a numeral 3;

FIG. 4 is an enlarged plan view of a lighting module incorporating my invention;

FIG. 5 is an enlarged bottom view of the lighting module of FIG. 4;

FIG. 6 is an enlarged side elevational view of the module of FIGS. 4 and 5;

FIG. 7 is an enlarged view of an alternate spring clip for lead free attaching lamp wires to the lighting module of the invention;

FIG. 8 is an enlarged perspective view of the battery clip forming part of the module of FIGS. 4 and 5;

FIG. 9 is a perspective view of a switch with spring clips attaching the switch to the module of FIGS. 4 and 5;

FIG. 10 is a bottom perspective view of another embodiment of the module according to the invention;

FIG. 11 is an exploded view of the module of FIG. 10; and

FIG. 12 is a partially exploded drawing of a simplified lighting circuit for shoes and other garments and accessories in which no circuit board is employed.

DETAILED DESCRIPTION OF THE PREFERRED EMBODIMENT

Referring now to FIG. 1, a shoe 10 is shown having a prior art lighting system, electrical circuit board 12, including a battery 14 and a switch 16 in its heel. Connected to the electrical circuit board 12 are pairs of wires 18, 20, and 22 terminating in light sources, such as LEDs 24, 26, and 28, respectively, which are located in the shoe 10 such that they are readily visible and will attract attention of those nearby.

FIG. 1A is a perspective view showing a lighting system of the invention as encapsulated in a potting compound. Within the normally transparent encapsulation layer 15 are shown electrical components, such as a circuit board 12, a battery 14, and a switch 16. Conductors 20 and 22 connect lamps or LEDs 27 and 29 of FIG. 1 to the system. Encapsulation of the system protects not only the components, but the connections as described below.

FIG. 2 is a front view of an individual 30 wearing an article of clothing, specifically a shirt or jacket 32 having light-transmitting strips 34 and 36, preferably of plasticized polyvinyl chloride (PVC), secured to its sleeves. Details of this garment and lighting strips are described in greater detail in U.S. Pat. No. 5,649,755 of this inventor. Light-transmitting strips 34 and 36 are illuminated by lamps or LEDs connected to a circuit board 12 or a similar board, including a switch 16 or a switch 74, as shown in FIGS. 1 and 2 or FIGS. 4–6, respectively. Upon movement of the individual wearing the shirt of jacket 32, switch 16 will close the circuit on circuit board 12 causing illumination of the lamps or LEDs 61 and 62, which causes light to travel through strips 34 and 36.

FIG. 3 is an enlarged view of the encircled portion 3 of FIG. 2. The sleeve of jacket 32 includes light-transmitting strips 34 and 36 ends of which are in close proximity to LEDs 61 and 62. LEDs 61 and 62 are connected to circuit board 12 such that movement of the individual 30, and particularly of his arms, will cause momentary closure of switch 16 resulting in illuminating of LEDs 61 and 62. This momentary illumination of the LEDs will cause light-transmitting strips 34 and 36 to be illuminated also. The lighting system of FIG. 3 would typically be encased in potting material which has been deleted for clarity.

FIG. 4 is an enlarged plan view of a lighting module incorporating my invention. A circuit board 50 includes an integrated circuit 52 connected through conductive traces $T_1$ and $T_2$ on the circuit board to terminals 54, 56, each of which are connected to one conductor of a double conductor wire 58. Wire 58 is connected with non-lead spring clamp fasteners 60, 60' to an LED or lamp 62. The opposite end of wire 58 is connected to terminals 54, 56 by means of fasteners similar to spring clamp fasteners 60, 60' or other non-lead crimped fasteners. Fasteners securing leads from wire 58 have not been shown to avoid obscuring connections from wire 58 to terminals 54 and 56 on printed circuit board 50. Because of the close proximity of metal fasteners 60, 60' and of other fasteners described herein, it may be necessary to provide insulating tubing over the bare wire ends of an LED or lamp 62 to avoid short circuits.

A battery 64, largely concealed by circuit board 50 in FIG. 4, is held against the lower side of circuit board 50 by means of a spring clamp 66 having an arm 68 contacting a trace $T_4$ on the top of circuit board 50 and another lower arm 70 (not visible in this view but appearing in FIG. 5) contacting one side (+terminal) of the battery 64. A smaller spring clamp 72, extending through a notch 51 of the circuit board, contacts the upper or opposite side (– terminal)) of the battery and connects it to track or trace $T_1$ on the top of circuit board 50. A switch 74 having spring clamps 76 and 78 is shown spaced from circuit board 50 and contact pads or traces $T_5$ and $T_6$. Clamps 76 and 78 are normally clamped to contact pads or traces $T_5$ and $T_6$ on circuit board 50 as indicated by the dashed lines.

FIG. 5 is an enlarged bottom view of the lighting module of FIG. 4. Visible in this view are battery 64, circuit board 50, spring clamp 66 including lower arm 70, lamp lead wires 58, spring clamps 60 and 60', lamp 62, and switch 74 with spring clamps 76 and 78 (exploded from the board 50).

FIG. 6 is a side elevational view of the module of FIGS. 4 and 5 after encapsulation with part of the encapsulation broken away to show the interior. Note that the battery 64 is mechanically clamped to the bottom of circuit board 50 by means of the spring clamp 66 and provides an electrical connection between the positive side of battery 64 and a conductor trace or track $T_3$ (FIG. 4) on circuit board 50. The separate small clamp 72 contacts the negative side of battery 64 and passes through notch 51 (FIG. 4) providing an electrical connection to another conducting trace $T_4$ on the face of circuit board 50. The switch 74 is visible on the back side of circuit board 50 and battery 64. When the module is assembled as described, it is encapsulated in potting compound 75. Once the potting resin cures, it will shrink approximately 6% creating a compressional force on all connections inside, enhancing reliability.

FIG. 7 shows an alternative structure for mechanically and electrically connecting wires 58 to circuit board 50. A generally "S" shaped spring clip 80 includes an arm 82 extending below circuit board 50, another arm 84 extending across the top of circuit board 50 and contacting a conductor trace 86, and a further doubled back arm 88 which includes a loop 90 to which one of wires 58 is crimped. An identical spring clip could be used to connect the second conductor wire of 58 to a second trace similar to trace 86.

FIG. 8 is a perspective view of the spring clamp 66 which is generally U-shaped with a shorter arm 68 and a longer arm 70. Spring clamp 66 will necessarily be quite stiff to secure battery 64 and circuit board 50 together. Clamp 66 is of a suitable metal, such as spring steel, brass or bronze, and is electrically conductive. Clamp 72 (FIG. 9) is also of spring material and is similarly conductive.

FIG. 9 shows switch 74 with clamps 76 and 78 extending through the sidewall of switch 74 to serve as contacts. Switch 74 is preferably the free rod in a closed tube-type switch of my co-pending application Ser. No. 10/766,709 filed Jan. 27, 2004.

Clamps 76 and 78 of FIGS. 4 and 5 are as shown in FIG. 9. The lengths and widths of the arms in any of the described clamps can be varied to suit requirements. Spring hardness can be applied to the section used as a spring clamp only, as to allow crimping when necessary.

FIG. 10 is a bottom perspective view of another embodiment of the invention prior to encasement or encapsulation. A circuit board 100 includes a plurality of holes 102, 103, 104, 105, 106, and 108 therethrough which communicate with electrical contacts each connected to a conductor track on the top side of the circuit board 100 (unshown). Lamp wires 114, 116, and 118 are fed through holes 102, 103, 104, 105, 106, and 108, respectively, and bent over to make contact with the desired conductor traces T (unshown) on the upper side of the board 100.

A resistor 120 is positioned on the lower side of the circuit board 100 and includes leads which pass through ports 122 and 124, and which are then crimped over to make contact with conductor traces T or tracks on the top side of circuit board 100. Other components may be located on the top of circuit board 100. Their leads are extended along the tops of the desired conductor traces T and are pressed down on the conductor traces T by means of a polyfoam pad 126, which is non-conductive and which is somewhat thicker than the height of any component on the top side of the circuit board 100. Pad 126 may have cut-outs to conform to components. A preferred material for pad 126 is a resilient, non-conductive polyfoam, such as polyurethane foam.

Pad 126 is then pressed tightly against circuit board 100 and any components or leads thereon by means of a hard, non-flexible board 130 that may be fastened to the circuit board by means of screws 128 or other suitable mechanical clamping devices.

FIG. 11 is a side view, partially exploded, of a module similar to that of FIG. 10. In this view, the circuit board 100 has a series of holes or bores at one end for receiving wires from the lamps. A bore B is visible that receives a wire 108 which is crimped against a conductor trace T on circuit board 100. A wire 132 from a switch 134 is fed through another bore 136 and crimped over against a conductor trace T on the upper surface of circuit board 100.

A resistor 138 is mounted on the lower side of the circuit board and has leads 140, 142 which are fed through bores 144 and 146, respectively, and are crimped over against conductor traces T on the surface of circuit board 100. A capacitor 148 has leads 150 and 152 which are aligned with conductor traces T. Another component 154, which may be an integrated circuit or surface mount device, also has leads 156, 158, which are aligned along conductor traces T on the surface of circuit board 100. Placement and alignment can also be accomplished with a resilient, non-conductor polyfoam pad that has been molded, tooled or carved out with cavities that hold electronic components in precise alignment with PCB (Printed Circuit Board) traces T, then clamped down for electrical connection as described below to facilitate assembly.

Placed over the top of circuit board 100 and the various leads and components located thereon is a resilient, non-conductive polyfoam pad 160 of somewhat greater thickness than the height of any component on the top surface of circuit board 100. Overlaying pad 160 is a hard, non-flexible board 162 serving as a clamp to clamp pad 160 hard against the top surface circuit board 100, thereby forcing all of the several leads tightly against their respective conductor traces T and thereby effecting electrical connections between the respective leads and conductor traces T.

A convenient way of providing such clamping force is by means of screws 128 passing through the circuit board 100 and board 162. Other mechanical arrangements may be used and may be advantageous for modules of a somewhat different construction. It is contemplated that some construction may be best effected by a combination of the above described spring clamps and the resilient pad and such pressure-applying means as a hard backing board.

Once the circuit module is assembled as described above, it will typically be potted to hold all parts in position and further secure all electrical connections since the shoes, garments, or accessories described must be designed to withstand much physical abuse.

FIG. 12 is a partially exploded drawing of a simplified lighting circuit for shoes and other garments and accessories in which no circuit board is employed. A switch 164 which is, or may be, the same as switch 74 (FIG. 9) has exterior contacts which may be spring or pad clamps 166, 168 mated to plugs 170, 172 clamped or crimped to insulated wires 174, 176. The opposite end of wire 174 is stripped and placed against one side of a battery 180 which may be a disk-type battery, such as battery 14. Placed against the opposite side of battery 180 is a stripped end of an insulated wire 182. The opposite ends of wires 182 and 176 are crimped or clamped to wires 186 and 184, respectively, which are crimped or clamped to leads 188 and 190 from a lamp or LED 192.

Shown spaced from wires 174 and 182 are polyfoam insulating pads 194 and 196. Adjacent pads 194 and 196 are hard boards or clamps 198 and 200, respectively. A screw 202 is shown passing through boards 198 and 200 and polyfoam pads 194 and 196. This screw and preferably at least one other such screw are tightened down to clamp polyfoam pads 194 and 196 securely against the stripped ends of wires 174 and 182 assuring their contact, both electrical and mechanical, with battery 180.

As in other systems described above, quick movement of switch 164 will close the switch contacts connecting battery 180 to LED 192. All electrical connections are accomplished by clamping or crimping or by means of the friction of plug in sockets and no solder is used or required anywhere in the system.

The term "potting" as used herein refers to a form of protective encapsulation which is effective to prevent moisture entering the protected module which could damage it and prevent its operation. The potting also provides mechanical protection against any outside contact. The module is normally enclosed in fabric, either in a shoe or on the clothing, but is still subject to possible damage in use. The potting then provides an effective skin of substantial thickness, e.g., 1/16 to 1/8 of an inch, around the module. This is illustrated in FIG. 1A which shows a completed system with only insulated wires extending out of the module.

The preferred encapsulating material is polyester resin. Epoxies and thermal set plastics may also be used. Each of these materials has a property of shrinking upon curing or cooling, producing a compressional force on all connections resulting in a more reliable circuit. In order to be assured that the potting step itself does not damage or interfere with the reliability of any of the mechanical/electrical connections, it was determined that a test program was necessary. Now with the elimination of solder, it is essential that all mechanical/electrical connections, either by spring force, crimping, swedging, or clamping in accordance with this invention, remain effective. A number of tests were conducted to determine the reliability of the connections.

I have taken test samples of various connections with wire leads exposed with their mechanical connection, measured resistance and found virtually zero resistance through each of those joints after assembly. I have then subjected them to potting with the preferred form of potting compound, namely, casting resin and have taken measurements of resistance across the joints shortly after the potting compound was applied and found no change in resistance. I again measured the resistance across each of the joints upon final curing of the potting compound and again found no change in resistance across the connections.

The module was also subjected to outside temperatures, ranging from below freezing to very hot (30° F. to 120° F.) under desert conditions, and I found no change in the resistance during or after a period of a few weeks. These results satisfied me that the step of potting did not deteriorate the electrical connection regardless of which type of connection it was that I used and that the shrinkage only added to the integrity of the joints.

The equipment used per my measurements was a Radio Shack battery source digital volt-ohm meter accurate to 1/10th of an ohm. Based upon these results, I am satisfied that I have demonstrated that it is possible to have a truly lead-free module with shelf and usage life equal or better than previous lead soldered assemblies.

The above-described embodiments of the present invention are merely descriptive of its principles and are not to be considered limiting. Although the above description has contemplated electronic modules powering LEDs or other lamps for shoes or other clothing, it will be apparent that the electrical module and connecting devices described above would also be effective for powering sound devices, either along or with a receiver responding to a remote transmitter, or other communication devices embedded in shoes or clothing. The scope of the present invention instead shall be determined from the scope of the following claims including their equivalents.

Where the claims herein refer to "spring clamps" or a "clamp member", it should be understood that such reference refers to any of crimped leads, clamped contacts, mechanical clamps, or a plug having a friction fit in a socket.

I claim:

1. An electronic module for illuminating a lamp in a shoe or other clothing or accessories, said module comprising:

a) a circuit board including a plurality of conductor traces;

b) a lamp and wires connecting said lamp to said circuit board;

c) a power source; and d) a switch connected to said circuit board wherein mechanical, lead-free connections are used between said lamps and said wires, between said wires and said circuit board, between said power source and said circuit board, and between said switch and said circuit board;

e) non-conducting foam pressure pads;

f) wherein at least a plurality of electrical connections in said module, all of which are lead (Pb) free and selected from the following group:

spring clips;

clamped contacts;

crimped leads pressure pad applied contacts; and engaging said circuit board and said pressure pad to insure contact pressure applied to at least some of the electrical connections.

2. An electronic module for illuminating a lamp in a shoe or other clothing or accessories, said module comprising:

a) a circuit board including a plurality of conductor traces;

b) electronic components having leads adjacent said conductor traces;

c) a lamp and wires connecting said lamp to said circuit board;

d) a power source;

e) a non-conductive foam pressure pad of greater thickness than the height of said components;

f) a switch connected to said circuit board wherein mechanical, lead free connections are used between said lamps and said wires, between said wires and said circuit board, between said power source and said circuit board, and between said switch and said circuit board; and g) wherein each electrical connection in said module is selected from the following:

spring clips;

clamped contacts;

crimped leads; and pressure pad applied contact;

said non-conductive foam pressure pad engaging said circuit board, said electronic components and said leads to insure contact pressure is applied to at least some of said electrical connections.

3. An electronic module for illuminating a lamp in a shoe, clothing or accessories, said module comprising:

a) a circuit board including a plurality of conductor traces;

b) a lamp and wires connecting said lamp to said circuit board;

c) a power source;

d) a switch connected to said circuit board; and e) a non-conductive foam pressure pad;

wherein only mechanical, lead (Pb)-free connections are used between said lamps and said wires, between said wires and said circuit board, between said power source and said circuit board, and between said switch and said circuit board; and said foam pressure pad engages said circuit board to insure contact pressure is applied to at least some of said electrical connections.

4. An electronic module as claimed in claim 3 wherein one of said mechanical lead free connections includes a spring clamp mechanically securing and electrically connecting said battery to said circuit board.

5. An electronic module for illuminating a lamp in a shoe, clothing or accessories, said module comprising:

a) a circuit board including a plurality of conductor traces;

b) a lamp and wires connecting said lamp to said circuit board;

c) a power source; and d) a switch connected to said circuit board wherein mechanical, lead-free connections are used between said lamps and said wires, between said wires and said circuit board, between said power source and said circuit board, and between said switch and said circuit board;

wherein said mechanical lead free connections include a flexible, non-conductive foam pad positioned on a side of said circuit board having conductor traces, and a clamp member forcing said foam pad against said circuit board to press said wires against said conductor traces.

6. An electronic module as claimed in claim 5 wherein an electronic component having leads is positioned against said circuit board and said leads are fed through said circuit board and held in contact with conductor traces by said foam pad and said clamp member.

7. An electronic module as claimed in claim 5 wherein an electronic component having leads is positioned against said circuit board and said leads are aligned with conductor traces on said circuit board and held in contact with said conductor traces by said foam pad and said clamp member.

8. An electronic module as claimed in claim 5 wherein said module is encapsulated in a potting compound.

9. An electronic module as claimed in claim 5 wherein spring clamps mechanically secure said battery to said circuit board.

10. An electronic module for illuminating a lamp in a shoe or other clothing or accessories, said module including:

a) a circuit board;

b) a battery connected to said circuit board;

c) a lamp and wires connected to said circuit board; and d) a switch connected to said circuit board characterized in that at least a plurality of said connections are secured by non-conducting foam pressuring-applying means.

11. An electronic module as claimed in claim 10 wherein said circuit board includes conductor traces, said battery has two sides of opposite polarity and said connections between said battery and said circuit board include a first spring clamp connecting one side of said battery to one of said conductor traces, and another spring clamp connecting the opposite side of said battery to another of said conductor traces.

12. An electronic module for illuminating a lamp in a shoe, clothing or accessories, said module comprising:

a) a circuit board including a plurality of conductor traces;

b) a lamp and wires connecting said lamp to said circuit board;

c) a power source; and d) a switch connected to said circuit board wherein mechanical, lead-free connections are used between said lamps and said wires, between said wires and said circuit board, between said power source and said circuit board, and between said switch and said circuit board;

wherein said mechanical lead free connections include a flexible, non-conductive foam pad positioned on a side of said circuit board having conductor traces, and a clamp member forcing said foam pad against said circuit board to press said wires against said conductor traces;

wherein said module is encapsulated in a potting compound; and wherein said circuit board includes conductor traces, said switch includes two terminals and spring clamps are positioned between each of said terminals and a conductor trace.

13. An electronic module for illuminating a lamp in a shoe, clothing or accessories, said module comprising:

a) a circuit board including a plurality of conductor traces;

b) a lamp and wires connecting said lamp to said circuit board;

c) a power source; and d) a switch connected to said circuit board wherein mechanical, lead-free connections are used between said lamps and said wires, between said wires and said circuit board, between said power source and said circuit board, and between said switch and said circuit board;

wherein said mechanical lead free connections include a flexible, non-conductive foam pad positioned on a side of said circuit board having conductor traces, and a clamp member forcing said foam pad against said circuit board to press said wires against said conductor traces;

wherein said module is encapsulated in a potting compound; and wherein said spring clamps positioned between said terminals and conductor traces on said circuit board further provide mechanical connections between said switch and said circuit board.

14. An electronic module for use in illuminating lamps in shoes or other clothing, said module comprising:

a) a circuit board including a plurality of conductor traces and contacts connected to at least some of said traces;

b) a lamp and wires extending between said lamp and said contacts;

c) a battery and a clamp extending from said battery to one of said conductor traces;

d) clamps securing said wires to said contacts;

e) a switch having two terminals and spring clamps securing said switch to others of said conductor traces;

f) a resilient, non-conductive polyfoam pad overlying said circuit board; and g) a clamp device clamping said polyfoam pad against said circuit board.

15. An electronic module as claimed in claim 14 wherein said module is encapsulated in a potting compound.

16. An electronic module as claimed in claim 15 wherein said potting compound is subject to shrinkage tending to force said clamps against said circuit board.

17. An electronic module as claimed in claim 14 wherein said polyfoam pad includes formed cavities that hold electronic components in precise alignment with said conductor traces.

* * * * *